US006627584B2

(12) United States Patent
Ozbalik

(10) Patent No.: US 6,627,584 B2
(45) Date of Patent: Sep. 30, 2003

(54) AUTOMATIC TRANSMISSION FLUID ADDITIVE COMPRISING REACTION PRODUCT OF HYDROCARBYL ACRYLATES AND DIHYDROCARBYLDITHIOPHOSPHORIC ACIDS

(75) Inventor: Nubar Ozbalik, Midlothian, VA (US)

(73) Assignee: Ethyl Corporation, Richmond, VA (US)

( * ) Notice: Subject to any disclaimer, the term of this patent is extended or adjusted under 35 U.S.C. 154(b) by 0 days.

(21) Appl. No.: 10/056,115

(22) Filed: Jan. 28, 2002

(65) Prior Publication Data

US 2003/0153469 A1 Aug. 14, 2003

(51) Int. Cl.[7] ..... C10M 141/10

(52) U.S. Cl. ..... 508/192; 508/287; 508/433; 508/438; 508/463; 508/545; 508/551

(58) Field of Search ..... 508/192, 433, 508/438, 287, 429, 463, 545, 551

(56) References Cited

U.S. PATENT DOCUMENTS

| | | | |
|---|---|---|---|
| 2,284,409 A | | 5/1942 | Erath |
| 2,284,410 A | | 5/1942 | Farmer |
| 2,459,112 A | | 1/1949 | Oberright |
| 2,962,442 A | | 11/1960 | Andress |
| 2,984,550 A | | 5/1961 | Chamot |
| 3,036,003 A | | 5/1962 | Dolton |
| 3,087,936 A | | 4/1963 | Le Suer |
| 3,166,516 A | | 1/1965 | Kirkpatrick et al. |
| 3,172,892 A | | 3/1965 | Le Suer et al. |
| 3,184,411 A | | 5/1965 | Lowe |
| 3,184,474 A | | 5/1965 | Catto et al. |
| 3,202,678 A | | 8/1965 | Stuart et al. |
| 3,216,936 A | | 11/1965 | Le Suer |
| 3,219,666 A | | 11/1965 | Norman et al. |
| 3,236,770 A | | 2/1966 | Harvey et al. |
| 3,254,025 A | | 5/1966 | Le Suer |
| 3,272,746 A | | 9/1966 | Le Suer et al. |
| 3,275,554 A | | 9/1966 | Wagenaar |
| 3,281,428 A | | 10/1966 | Le Suer |
| 3,282,955 A | | 11/1966 | LeSuer |
| 3,329,658 A | | 7/1967 | Fields |
| 3,331,776 A | | 7/1967 | Krukziener |
| 3,338,832 A | | 8/1967 | Le Suer |
| 3,342,735 A | | 9/1967 | Reed et al. |
| 3,344,069 A | | 9/1967 | Stuebe et al. |
| 3,368,972 A | | 2/1968 | Otto |
| 3,381,022 A | | 4/1968 | Le Suer |
| 3,394,576 A | | 7/1968 | Shumaker |
| 3,403,102 A | | 9/1968 | Le Suer |
| 3,413,347 A | | 11/1968 | Worrel |
| 3,438,757 A | | 4/1969 | Honnen et al. |
| 3,442,808 A | | 5/1969 | Traise |
| 3,448,047 A | | 6/1969 | Traise et al. |
| 3,449,250 A | | 6/1969 | Fields |
| 3,454,497 A | | 7/1969 | Wittner |
| 3,454,555 A | | 7/1969 | van der Voort |
| 3,459,661 A | | 8/1969 | Schlobohm |
| 3,480,548 A | | 11/1969 | Hellmuth |
| 3,493,520 A | | 2/1970 | Dolton et al. |
| 3,502,607 A | | 3/1970 | Trapasso |
| 3,511,780 A | | 5/1970 | Neblett et al. |
| 3,513,093 A | | 5/1970 | Le Suer |
| 3,519,565 A | | 7/1970 | Coleman |
| 3,522,179 A | | 7/1970 | Le Suer |
| 3,533,945 A | | 10/1970 | Vogel |
| 3,539,633 A | | 11/1970 | Plasek et al. |
| 3,558,743 A | | 1/1971 | Verdol |
| 3,565,804 A | | 2/1971 | Honnen et al. |
| 3,576,743 A | | 4/1971 | Widmer et al. |
| 3,586,629 A | | 6/1971 | Otto et al. |
| 3,591,598 A | | 7/1971 | Traise et al. |
| 3,600,372 A | | 8/1971 | Udelhofen et al. |
| 3,632,511 A | | 1/1972 | Liao |
| 3,634,515 A | | 1/1972 | Piasek et al. |
| 3,649,229 A | | 3/1972 | Otto |
| 3,658,836 A | | 4/1972 | Vineyard |
| 3,666,730 A | | 5/1972 | Coleman |
| 3,671,511 A | | 6/1972 | Honnen et al. |
| 3,679,584 A | | 7/1972 | Hellmuth |
| 3,687,849 A | | 8/1972 | Abbott |
| 3,697,574 A | | 10/1972 | Piasek et al. |
| 3,702,300 A | | 11/1972 | Coleman |
| 3,703,536 A | | 11/1972 | Piasek et al. |
| 3,704,308 A | | 11/1972 | Piasek |
| 3,718,663 A | | 2/1973 | Piasek et al. |
| 3,725,277 A | | 4/1973 | Worrel |
| 3,725,480 A | | 4/1973 | Traise et al. |
| 3,726,882 A | | 4/1973 | Traise et al. |
| 3,736,357 A | | 5/1973 | Piasek et al. |
| 3,751,365 A | | 8/1973 | Piasek et al. |
| 3,751,530 A | * | 8/1973 | Diasek ..... 558/109 |
| 3,756,953 A | | 9/1973 | Piasek et al. |

(List continued on next page.)

FOREIGN PATENT DOCUMENTS

| | | | |
|---|---|---|---|
| EP | 0 107 282 | | 5/1984 |
| GB | 1287331 | * | 8/1972 |
| GB | 1347845 | * | 2/1974 |
| GB | 1 569 730 | | 6/1980 |

OTHER PUBLICATIONS

Brock, D., "Lubricant Base Oils,", Lubrication Engineering, Mar. 1987, pp. 184–185.

*Primary Examiner*—Jacqueline V. Howard
(74) *Attorney, Agent, or Firm*—Leah Oubre Robinson; Dennis H. Rainear

(57) ABSTRACT

The present invention provides a power transmission lubricating composition containing a base oil, a dispersant, a lubricant additive produced by the reaction of a dihydrocarbyldithio-phosphoric acid and a hydrocarbyl acrylate, and optionally a viscosity index improver. Improved friction performances in automatic and continuously variable transmissions are achieved by utilizing the fluids of the present invention in ash-free lubricating oil compositions for transmissions and axles.

41 Claims, No Drawings

U.S. PATENT DOCUMENTS 3,784,588 A * 1/1974 Miles ..... 558/160
3,793,202 A 2/1974 Piasek et al.
3,798,165 A 3/1974 Piasek et al.
3,798,247 A 3/1974 Piasek et al.
3,803,039 A 4/1974 Piasek et al.
3,804,763 A 4/1974 Meinhardt
3,821,302 A 6/1974 Hu
3,836,471 A 9/1974 Miller
3,862,981 A 1/1975 Demoures et al.
3,872,019 A 3/1975 Culbertson et al.
3,904,595 A 9/1975 Plonsker et al.
3,929,650 A 12/1975 King et al.
3,936,480 A 2/1976 Demoures et al.
3,948,800 A 4/1976 Meinhardt
3,950,341 A 4/1976 Okamoto et al.
3,957,746 A 5/1976 Malec
3,957,854 A 5/1976 Miller
3,957,855 A 5/1976 Miller
3,980,569 A 9/1976 Pindar et al.
3,985,802 A 10/1976 Piasek et al.
3,991,098 A 11/1976 Okamoto
4,006,089 A 2/1977 Chibnik
4,011,380 A 3/1977 West et al.
4,025,451 A 5/1977 Plonsker et al.
4,058,468 A 11/1977 Malec
4,071,548 A 1/1978 Okamoto
4,083,699 A 4/1978 Chibnik
4,090,854 A 5/1978 Davis
4,119,549 A 10/1978 Davis
4,119,550 A 10/1978 Davis et al.
4,148,981 A * 4/1979 Pellegrini et al. ..... 525/326.7
4,173,540 A 11/1979 Lonstrup et al.
4,191,659 A 3/1980 Davis
4,234,435 A 11/1980 Meinhardt et al.
4,326,972 A 4/1982 Chamberlin, III
4,344,854 A 8/1982 Davis et al.
4,354,950 A 10/1982 Hammond et al.
4,455,243 A 6/1984 Liston
4,485,023 A 11/1984 Serres et al.
4,582,618 A * 4/1986 Davis ..... 508/338
4,615,826 A 10/1986 Erdman
4,648,980 A 3/1987 Erdman
4,652,387 A 3/1987 Andress, Jr. et al.
4,744,920 A 5/1988 Fischer et al.
4,792,410 A 12/1988 Schwind et al.
4,857,214 A 8/1989 Papay et al.
5,198,133 A * 3/1993 Papay ..... 508/188
5,354,485 A 10/1994 Tipton et al.
5,403,501 A 4/1995 Schwind
5,464,548 A 11/1995 Cahoon et al.
5,484,542 A 1/1996 Cahoon et al.
5,972,851 A * 10/1999 Srinivasan et al. ..... 508/188

* cited by examiner

AUTOMATIC TRANSMISSION FLUID ADDITIVE COMPRISING REACTION PRODUCT OF HYDROCARBYL ACRYLATES AND DIHYDROCARBYLDITHIOPHOSPHORIC ACIDS

FIELD OF THE INVENTION

The present invention relates to an automatic transmission fluid (ATF) composition and continuously variable transmission (CVT) fluids containing the reaction product of a hydrocarbyl acrylate, or hydrocarbyl acrylamide, and a dihydrocarbyldithiophosphoric acid. More specifically, the present invention relates to ash-free lubricating oil compositions for power transmitting fluids that exhibit unusually high and durable torque capacity in friction tests. In one embodiment of the present invention there is a useful reaction product of $C_{10}$ to $C_{20}$ hydrocarbyl acrylate(s) with dihydrocarbyldithiophosphoric acids.

BACKGROUND OF THE INVENTION

OEMs have adapted a variety of friction tests designed to identify ATFs that maintain their initial shudder-free performance at friction levels that translate to better fuel efficiency. Only a few fluids that are commercially available can meet current torque capacity and friction durability targets in specified durability tests.

U.S. Pat. No. 5,403,501 teaches lubricating compositions for manual transmissions comprising a phosphorous-containing compound.

Great Britain Patent Application No. 1569730A teaches a lubricating oil composition comprising the reaction product of an alcohol and $P_2S_5$ and ethyl acrylate.

U.S. Pat. No. 4,792,410 issued to Schwind et al. relates to lubricant compositions suitable for manual transmission fluids.

U.S. Pat. No. 4,744,920 issued to Fischer et al. relates to carbonated overbased products which are borated and processes for making the same.

U.S. Pat. No. 3,929,650 issued to King et al. discloses borated overbased alkali metal carbonates of metal sulfonates.

U.S. Pat. No. 3,480,548 issued to Hellmuth et al. discloses overbased boronated products.

U.S. Pat. No. 3,679,584 issued to Hellmuth relates to overbased alkaline earth metal sulfonates reacted with boric acid.

U.S. Pat. Nos. 4,119,549 and 4,191,659 issued to Davis and U.S. Pat. Nos. 4,119,550 and 4,344,854 issued to Davis et al. relate to sulfurized compositions prepared by the reaction of olefin compounds with a mixture of sulfur and hydrogen sulfide.

U.S. Pat. No. 5,354,485 teaches a composition comprising a major amount of an oil of lubricating viscosity, and an organic ammonium thiosulfate.

U.S. Pat. Nos. 5,464,548 and 5,484,542 also illustrate lubricating compositions containing sulfurized components.

An objective of this invention is to provide a power transmitting fluid that meets or exceeds the requirements of current friction performance tests in terms of both durability and torque capacity.

SUMMARY OF THE INVENTION

A feature of the present invention is to provide a lubricating oil composition containing an additive prepared from the reaction of a hydrocarbyl acrylate, or a derivative thereof, and a dihydrocarbyldithiophosphoric acid.

Another feature of the present invention is to provide a power transmitting fluid containing a reaction product produced by the reaction of a hydrocarbyl acrylate, or a derivative thereof, and a dialkyldithiophosphoric acid. By "power transmitting fluid" herein is meant any fluid or composition useful for transmitting or conveying power or pressure, such as but not limited to hydraulic fluids, gear oils, ATFs and CVT fluids.

A further feature of the present invention is to provide a method of improving simultaneously the friction stability, durability, and torque capacity of a transmission fluid.

Accordingly, the present invention relates to an ash-free lubricating oil composition for power transmitting fluids including CVT.

According to an embodiment of the present invention, there is provided herein a clear superiority of lubricating and power transmitting oil compositions of the present invention over commercialy available oils optimized to provide friction stability and high torque capacity.

Static coefficient of friction measured as $\mu_s$ and $\mu_t$ are particularly important in the commercialization of power transmitting fluids since automakers look at these parameters as a measure of torque capacity. In the present invention; by "$\mu_s$" is meant the static-coefficient of friction calculated by the formula 3.6.2 of JASO M 348-95 by the peak torque Ts after drag is started. By "$\mu_t$" what is meant in the present invention is the static friction coefficient calculated by the formula 3.6.2 of JASO M 348-95 using the stable torque two seconds after dragging is started. By "$\mu_0$" what is meant herein is the dynamic friction coefficient calculated by 3.6.2 of JASO M 348-95 using the maximum torque on the completion of the stopping at 200 r/min, and by "$\mu_d$" what is meant herein is the dynamic friction coefficient calculated using friction torque at the time when the number of revolutions reaches 1800 r/min. Another key friction performance parameter is $\mu_0/\mu_d$, which is regarded as indicative of vehicle shudder characteristics of the fluid. The desired value of the $\mu_0/\mu_d$ parameter is less than 1.0. The compositions of the present invention are better in this $\mu_0/\mu_d$ parameter than that of a commercial power transmitting fluid that meets current durability requirements of Japanese OEMs. From this point on, this fluid will be cited as the reference fluid.

In the JASO M 348-95 test, the data is obtained using a paper-on-steel type of surface contact. The paper friction material used in the JASO test was SD-1777, available from Borg-Warner Automotive.

The power transmitting fluids of the present invention that are formulated containing the reaction products of hydrocarbyl acrylates with dihydrocarbyldithiophosphoric acids give unusually high $\mu_t$ and $\mu_d$ levels in a SAE#2 machine when tested as taught in the JASO procedure cited above. The friction levels for power transmitting fluids of the present invention containing the reaction products described herein exhibit minimal variation during 5,000 cycles. The reference fluid shows a lower (unstable) level of $\mu_d$ and much lower level of $\mu_t$ relative to the corresponding values for compositions of the present invention.

As an indicator of shudder performance, both the baseline fluid (i.e., no friction modifiers added) and reference oil show $\mu_0/\mu_d$ greater than 1.0, while the same parameter for the ATFs and CVTs formulated with the compositions of the present invention provide $\mu_0/\mu_d$ parameter values close to or below 1.0. For improved anti-shudder performance, a lower $\mu_0/\mu_d$ parameter is desirable.

The present invention further relates to methods to improve the power transmission in vehicles by incorporation into the power transmitting fluid a power transmitting fluid composition of the present invention.

It is to be understood that both the foregoing general description and the following detailed description are exemplary and explanatory only and are intended to provide further explanation of the present invention, as claimed.

DETAILED DESCRIPTION OF THE PRESENT INVENTION

The present invention relates in an embodiment to ash-free lubricating oil compositions for power transmitting fluids that exhibit unusually high and durable torque capacity in friction tests.

Thioacids

Useful in an embodiment of the present invention is a reaction product of $C_6$ to $C_{20}$ hydrocarbyl acrylate(s) with dihydrocarbyldithiophosphoric acids, such as di-iso-propyl/methylisobutylcarbinol mixed (IPA-MIBC) dithiophosphoric acid; di-2-ethylhexyl dithiophosphoric acid (2-EH); and di-isodecyl dithiophosphoric acid.

By "hydrocarbyl" in "dihydrocarbyldithiophosphoric" herein is meant any hydrocarbyl groups including linear and branched alkyl, alkenyl, alkaryl, aralkyl, or aryl, with a preferred chain length of up to about twenty carbon atoms. Preferred dihydrocarbyldithiophosphoric acids herein include dialkyldithiophosphoric acids. Particularly preferred are dialkyldithiophosphoric acids where the alkyl groups are independently selected from methyl, ethyl, n-propyl, i-propyl, n-butyl, i-butyl, t-butyl, pentyl, hexyl, 2-ethyl hexyl, heptyl, octyl, nbnyl, decyl, undecyl, dodecyl, lauryl, eicosyl, cetyl, and mixtures thereof. A preferred chain length in an embodiment is $C_2$ to $C_{10}$. Also useful herein as the dithiophosphoric acids are precursors thereof capable of generating or producing in situ the corresponding dithiophosphoric acids. Such precursors can include the corresponding acid salts, such as ammonium salts, or the alcohol and $P_2S_5$.

Acrylates

The hydrocarbyl acrylates useful in the present invention can include without limitation lauryl methacrylate (LMA), cetyl eicosyl methacrylate (CEMA), and dimethylaminopropyl methacrylamide (DMAPMAD). It is recognised that DMAPMAD is not an acrylate, but as a derivative thereof, is included in the acrylate definition for this invention. Preferred are hydrocarbyl groups of $C_{10}$ to $C_{20}$. Examples of commercially available materials useful in the reaction described herein include, but are not limited to, isobutyl acrylate; tert-butyl acrylate; n-hexyl acrylate; n-hexyl methacrylate; isodecyl methacrylate; lauryl methacrylate; stearyl methacrylate; isooctyl acrylate; lauryl acrylate; stearyl acrylate; cyclohexyl acrylate; cyclohexyl methacrylate; methoxy ethyl acrylate; isobenzyl acrylate; isodecyl acrylate; n-dodecyl acrylate; benzyl acrylate; isobornyl acrylate; isobornyl methacrylate; 2-hydroxyethyl acrylate; 2-hydroxypropyl acrylate; 2-methoxyethyl acrylate; 2-methoxybutyl acrylate; 2-(2-ethoxyethoxy) ethyl acrylate; 2-phenoxyethyl acrylate; tetrahydrofurfuryl acrylate; 2-(2-phenoxyethoxy) ethyl acrylate; methoxylated tripropylene glycol monoacrylate; 1,6-hexanediol diacrylate; ethylene glycol dimethacrylate; diethylene glycol dimethacrylate; triethylene glycol dimethacrylate; polyethylene glycol dimethacrylate; butylene glycol dimethacrylate; trimethylolpropane 3-ethoxylate triacrylate; 1,4-butanediol diacrylate; 1,9-nonanediol diacryiate; neopentyl glycol diacrylate; tripropylene glycol diacrylate; tetraethylene glycol diacrylate; heptapropylene glycol diacrylate; trimethylol propane triacrylate; ethoxylated trimethylol propane triacrylate; pentaerythritol triacrylate; trimethylolpropane trimethacrylate; tripropylene glycol diacrylate; pentaerythritol tetraacrylate; glyceryl propoxy triacrylate; tris(acryloyloxyethyl) phosphate; 1-acryloxy-3-methacryloxy glycerol; 2-methacryloxy-N-ethyl morpholine; and allyl methacrylate; and mixtures thereof. Also useful herein as the hydrocarbyl acrylates are derivatives thereof, such as, amides, cyano, phenyl, or other functional derivatives which promote electrophilic addition to the olefinic bond of the acrylate.

In an embodiment, the present invention provides an ATF lubricating and/or power-transmitting composition containing a lubricant additive composition prepared by the reaction of a $C_6$ to $C_{20}$, preferably $C_{10}$ to $C_{20}$, hydrocarbyl acrylate and a hydrocarbyldithiophosphoric acid. In a preferred embodiment, the acrylate is selected from the group consisting of LMA, CEMA, and DMAPMAD. In another embodiment, the dihydrocarbyldithiophosphoric acid is selected from the group consisting of IPA-MIBC, 2-EH, and di-isodecyl dithiophosphoric acids.

The reaction between the hydrocarbyl acrylate and the dihydrocarbyldithiophosphoric acid according to an embodiment of the present invention can generally be depicted by the following reaction:

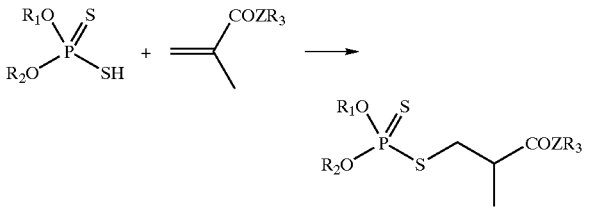

In this reaction, $R_1$ and $R_2$ and $R_3$ can be as defined herein above. Z can be an oxygen atom or a nitrogen atom. While this scheme illustrates a methacrylate, the reaction can alternatively use acrylates.

The reaction product of the present invention shall include any covalently bonded chemical product or intermediate, as well as any ionicly bonded product or intermediate, such as a salt, which may result from the combination of the acrylate, or aminohydrocarbyl acrylamide, and the dithioacid, according to the present invention.

By "reaction product" herein is meant the product or mixture of products formed by bringing into contact for an appropriate period of time and under sufficient conditions of temperature, catalysts, and/or pressure the hydrocarbyl acrylate and the dihydrocarbyldithiophosphoric acid as described herein. "Reaction" herein can include a change in chemical or physical properties or appearance, as well as an unchanged blend, mix, admixture, pre-mix, or precursors thereof. "Reaction" can also include the chemical bonding and/or joining of the acrylate and the dithiophosphoric acid. Thus, according to the present invention, the mere contacting, blending, mixing, or joining of the acrylate and the dithiophosphoric acid without heat, pressure, or other reaction-initiating stimulus is still within the scope of the present invention. The generation in situ of one or both of the acrylate and the dithiophosphoric acid is also contemplated within the scope of the present invention.

Reaction products useful in the present invention can include materials known to those skilled in the art, such as ethyl 3-[(dimethoxyphosphino-thioyl)thio]-2-methylpropanoate; and dodecyl 3-[[bis(1-methylethoxy) phosphinothioyl]thio]-2-methylpropanoate.

One particular advantage of this reaction scheme is the virtual absence of any significant by-product. This absence improves the ease of manufacturing and eliminates vacuum steps, etc. In addition, no deleterious by-product remains in the reaction product to degrade friction performance. Any unreacted dithioacid can be readily neutralised with amines.

In an embodiment of the present invention, a reaction product is obtained by combining the dithiophosphoric acid and the hydrocarbyl acrylate in approximately equal molar amounts, that is, at approximately a 1:1 molar ratio. However, within the scope of the present invention are reaction products resulting from the combination of these reactants in other molar ratios, including molar ratios ranging from 1:99 to 99:1. A preferred molar ratio range of dithiophosphoric acid to hydrocarbyl acrylate is from about 1:3 to about 3:1. A more preferred molar ratio is approximately one mole of dithiophosphoric acid per one mole of hydrocarbyl acrylate. The reaction product of the hydrocarbyl acrylate and the dihydrocarbyldithiophosphoric acid can be most effective when present in the lubricating and power transmitting compositions of the present invention in an amount of from about 0.3 to about 5.0 weight percent, although higher and lower amounts are operative to achieve improved friction performance.

The reaction conditions useful for preparing a reaction product of the present invention can include, but are not limited to, combining, mixing, and/or stirring and heating.

Thus, in an embodiment, the present invention relates to an automatic transmission fluid composition comprising a) a major amount of an oil of lubricating viscosity; b) a minor amount of the reaction product of a hydrocarbyl acrylate with a dihydrocarbyldithiophosphoric acid; c) an ashless dispersant; and optionally, d) a viscosity index improver. The term "major amount" as used herein generally means a predominant amount, while a "minor amount" refers to an amount less than a major amount as defined herein. For example, the major amount of the oil of lubricating viscosity ingredient can represent an amount of 50 wt % or more, and more particularly, for example, between about 60 to about 95 wt. % of the overall composition, while the minor amount present of the reaction product of a hydrocarbyl acrylate with a dihydrocarbyldithiophosphoric acid can represent an amount, for example, of no more than about 5.0 wt. %.

The present invention is also directed to a method of preparing a lubricating and/or power transmitting oil composition containing a product resulting from the joining, contacting, and/or reacting of a dithiophosphoric acid and a hydrocarbyl acrylate. Lubricating and power transmitting compositions of the present invention containing the reaction product prepared from the reaction of a hydrocarbyl acrylate and a dithiophosphoric acid can, according to an embodiment of the present invention, be formulated into an oil of lubricating viscosity to provide a lubricating and power transmitting oil composition. Such oil compositions exhibit significantly enhanced friction properties and excellent friction durability performance, relative to the performance of conventional lubricating oil compositions without the reaction product taught in the present invention when tested on standard industry friction tests.

The compositions of the present invention containing the reaction product described herein can be used in lubricant oil formulations with additional components and additives known in the industry. Thus, additional components which can be combined with the reaction products described in the present invention in an oil of lubricating viscosity include, anti-corrosion additives, friction modifiers, viscosity modifiers, rust inhibitors, pour point depressants, oxidation inhibitors, and the like. In this manner, fully formulated power transmitting fluids are prepared according to an embodiment of the present invention.

Dispersants

Particularly useful additives to be used in the lubricating oil compositions of the present invention are dispersants, such as succinimides with alkyl or alkenyl substitution, such as a 950 MW polyisobutylene (PIB) residue. The dispersant may comprise at least one oil-soluble phosphorus or boron-containing ashless dispersant. The phosphorus or boron-containing ashless dispersants can be formed by phosphorylating or boronating an ashless dispersant having basic nitrogen and/or at least one hydroxyl group in the molecule, such as a succinimide dispersant, succinic ester dispersant, succinic ester-amide dispersant, Mannich base dispersant, hydrocarbyl polyamine dispersant, or polymeric polyamine dispersant.

The polyamine succinimides in which the succinic group contains a hydrocarbyl substituent containing at least 30 carbon atoms are described for example in U.S. Pat. Nos. 3,172,892; 3,202,678; 3,216,936; 3,219,666; 3,254,025; 3,272,746; and 4,234,435. The alkenyl succinimides may be formed by conventional methods such as by heating an alkenyl succinic anhydride, acid, acid-ester, acid halide, or lower alkyl ester with a polyamine containing at least one primary amino group. The alkenyl succinic anhydride may be made readily by heating a mixture of olefin and maleic anhydride to, for example, about 180–220 degrees C. The olefin is preferably a polymer or copolymer of a lower monoolefin such as ethylene, propylene, 1-butene, isobutene and the like and mixtures thereof. The more preferred source of alkenyl group is from polyisobutene having a gel permeation chromotography (GPC) number average molecular weight of up to 10,000 or higher, preferably in the range of about 500 to about 2,500, and most preferably in the range of about 800 to about 1,500.

As used herein the term "succinimide" is meant to encompass the completed reaction product from reaction between one or more polyamine reactants and a hydrocarbon-substituted succinic acid or anhydride (or like succinic acylating agent), and is intended to encompass compounds wherein the product may have amide, amidine, and/or salt linkages in addition to the imide linkage of the type that results from the reaction of a primary amino group and an anhydride moiety.

Alkenyl succinic acid esters and diesters of polyhydric alcohols containing 2–20 carbon atoms and 2–6 hydroxyl groups can be used in forming the phosphorus-containing ashless dispersants. Representative examples are described in U.S. Pat. Nos. 3,331,776; 3,381,022; and 3,522,179. The alkenyl succinic portion of these esters corresponds to the alkenyl succinic portion of the succinimides described above.

Suitable alkenyl succinic ester-amides for forming the phosphorylated ashless dispersant are described for example in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540.

Hydrocarbyl polyamine dispersants that can be phosphorylated are generally produced by reacting an aliphatic or alicyclic halide (or mixture thereof) containing an average of at least about 40 carbon atoms with one or more amines, preferably polyalkylene polyamines. Examples of such hydrocarbyl polyamine dispersants are described in U.S. Pat. Nos. 3,275,554; 3,394,576; 3,438,757; 3,454,555; 3,565,804; 3,671,511; and 3,821,302.

In general, the hydrocarbyl-substituted polyamines are high molecular weight hydrocarbyl-N-substituted polyamines containing basic nitrogen in the molecule. The hydrocarbyl group typically has a number average molecular weight in the range of about 750–10,000 as determined by GPC, more usually in the range of about 1,000–5,000, and is derived from a suitable polyolefin. Preferred hydrocarbyl-substituted amines or polyamines are prepared from polyisobutenyl chlorides and polyamines having from 2 to about 12 amine nitrogen atoms and from 2 to about 40 carbon atoms.

Mannich polyamine dispersants which can be utilized in forming the phosphorylated ashless dispersant is a reaction product of an alkyl phenol, typically having a long chain alkyl substituent on the ring, with one or more aliphatic aldehydes containing from 1 to about 7 carbon atoms (especially formaldehyde and derivatives thereof), and polyamines (especially polyalkylene polyamines). Examples of Mannich condensation products, and methods for their production are described in U.S. Pat. Nos. 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023.

The preferred hydrocarbon sources for preparation of the Mannich polyamine dispersants are those derived from substantially saturated petroleum fractions and olefin polymers, preferably polymers of mono-olefinis having from 2 to about 6 carbon atoms. The hydrocarbon source generally contains at least about 40 and preferably at least about 50 carbon atoms to provide substantial oil solubility to the dispersant. The olefin polymers having a GPC number average molecular weight between about 600 and 5,000 are preferred for reasons of easy reactivity and low cost. However, polymers of higher molecular weight can also be used. Especially suitable hydrocarbon sources are isobutylene polymers.

The preferred Mannich base dispersants for this use are Mannich base ashless dispersants formed by condensing about one molar proportion of long chain hydrocarbon-substituted phenol with from about 1 to 2.5 moles of formaldehyde and from about 0.5 to 2 moles of polyalkylene polyamine.

Polymeric polyamine dispersants suitable for preparing phosphorylated ashless dispersants are polymers containing basic amine groups and oil solubilizing groups (for example, pendant alkyl groups having at least about 8 carbon atoms). Such materials are illustrated by interpolymers formed from various monomers such as decyl methacrylate, vinyl decyl ether or relatively high molecular weight olefins, with aminoalkyl acrylates and aminoalkyl acrylamides. Examples of polymeric polyamine dispersants are set forth in U.S. Pat. Nos. 3,329,658; 3,449,250; 3,493,520; 3,519,565; 3,666,730; 3,687,849; and 3,702,300.

The various types of ashless dispersants described above can be phosphorylated by procedures described in U.S. Pat. Nos. 3,184,411; 3,342,735; 3,403,102; 3,502,607; 3,511,780; 3,513,093; 3,513,093; 4,615,826; 4,648,980; 4,857,214 and 5,198,133.

In another preferred embodiment, the dispersants or the phosphorus-containing dispersants of the present invention are also boronated.

Methods that can be used for boronating (borating) the various types of ashless dispersants described above are described in U.S. Pat. Nos. 3,087,936; 3,254,025; 3,281,428; 3,282,955; 2,284,409; 2,284,410; 3,338,832; 3,344,069; 3,533,945; 3,658,836; 3,703,536; 3,718,663; 4,455,243; and 4,652,387.

Preferred procedures for phosphorylating and boronating ashless dispersants such as those referred to above are set forth in U.S. Pat. Nos. 4,857,214 and 5,198,133.

The amount of ashless dispersant on an "active ingredient basis" (i.e., excluding the weight of impurities, diluents and solvents typically associated therewith) is generally within the range of about 0.5 to about 7.5 weight percent (wt %), typically within the range of about 0.5 to 6.5 wt %, preferably within the range of about 0.5 to about 5.5 wt %, and most preferably within the range of about 1.0 to about 4.5 wt %.

In a preferred embodiment of the present invention, an ashless dispersant with an N/P ratio as set forth in U.S. Pat. No. 5,972,851, which is incorporated herein by reference. In this preferred embodiment, an optional component of the present invention is a dispersant having a nitrogen to phosphorus mass ratio between about 3:1 and about 10:1. The dispersant of the preferred embodiment can be prepared in at least two ways. In one method, an ashless dispersant is phosphorylated to such a degree that the nitrogen to phosphorus mass ratio between about 3:1 and about 10:1. In another embodiment, a phosphorylated dispersant and a non-phosphorylated dispersant are blended together such that the total nitrogen to phosphorus mass ratio of the dispersant is between about 3:1 and about 10:1.

Overall, the dispersant is preferably present in the final fluid in an amount of about 1.00% to about 10.00% by weight, more preferably from about 1.00 weight % to about 7.00 weight %, most preferably about 3–6 weight %.

Viscosity Index Improver

The compositions of the present invention may also contain a viscosity index improver (VII). Preferred VIIs include, but are not limited to, olefin copolymer VIIs, polyalkylmethacrylate VIIs and styrene-maleic ester VIIs. Of these, polyalkylmethacrylate VIIs are particularly preferred. The viscosity index improver, if employed, can be supplied in the form of a solution in an inert solvent, typically a mineral oil solvent, which usually is a severely refined mineral oil. The viscosity index improver solution as received often will have a boiling point above 200° C., and a specific gravity of less than 1 at 25° C. Preferably, the viscosity index improver will have sufficient shear stability such that the finished composition possesses a kinematic viscosity of at least 5, and more preferably at least 6.8, cSt at 100° C. after 40 cycles in the FISST (Fuel Injector Shear Stability Test) of ASTM D-5275.

The VII, if used in the present invention, will also preferably have less than 5% shear loss on the tapered roller bearing test.

On an active ingredient basis (i.e., excluding the weight of inert diluent or solvent associated with the viscosity index improver as supplied), the finished fluid compositions of this invention will normally contain in the range of about 0 to about 25 wt % of the polymeric viscosity index improver. Small departures from this range may be resorted to as necessary or desirable in any given situation.

Suitable materials for use a VII include styrene-maleic ester VIIs such as LUBRIZOL® 3702, LUBRIZOL® 3706 and LUBRIZOL® 3715 available from The Lubrizol Corporation; polyalkylmethacrylate VIIs such as those available from RÖHM GmbH (Darmstadt, Germany) under the trade designations: VISCOPLEX® 5543, VISCOPLEX® 5548, VISCOPLEX® 5549, VISCOPLEX® 5550, VISCOPLEX® 5551 and VISCOPLEX® 5151, from Rohm & Haas Company (Philadelphia, Pa.) under the trade designations ACRYLOID® 1277, ACRYLOID® 1265 and ACRYLOID® 1269, and from Ethyl Corporation (Richmond, Va.) under the trade designation HiTEC® 5710 viscosity index improver; and olefin copolymer VIIs such as HiTEC® 5747 VII, HiTEC® 5751 VII, HiTEC® 5770 VII and HiTEC® 5772 VII available from Ethyl Corporation and SHELLVIS® 200 available from Shell Chemical Company. Mixtures of the foregoing products can also be used as well as dispersant and dispersantlantioxidant VIIs.

Preferably, the viscosity index improver will be provided as a hydrocarbon solution having a polymer content in the range of from about 25 to about 80 wt % and a nitrogen content in the range of about 0 to about 0.5 wt %. Such products preferably exhibit a permanent shear stability index (a PSSI value) using ASTM test method D-3945A of no higher than about 75, preferably 50 or less, and most preferably 35 or less.

Preferred is a dispersant polymethacrylate viscosity index improver such as HiTEC® 5738, or a non dispersant polymethacrylate viscosity index improver such as HiTEC®5739, both products of Ethyl Corporation, Richmond Va., or a mixture of dispersant and non-dispersant viscosity index improvers. Especially preferred is an ultra high shear stable dispersant polymethacrylate viscosity index improver such as HiTEC® 5769, also a product of Ethyl Corporation, Richmond, Va.

Base Oil

The lubricating oil compositions and methods of this invention employ an oil of lubricating viscosity, including natural or synthetic lubricating oils and mixtures thereof. Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of dicarboxylic acids and polyols, esters of phosphorus-containing acids, polymeric tetrahydrofurans and silicon-based oils, and mixtures thereof. Unrefined, refined and rerefined oils, either natural or synthetic may also be used in the compositions of the present invention. Specific examples of the oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by D. V. Brock, "Lubricant Engineering", volume 43, pages 184–185, March, 1987. This article is herein incorporated by reference for its disclosures relating to lubricating oils. A description of oils of lubricating viscosity occurs in U.S. Pat. No. 4,582,618 (column 2, line 37 through column 3, line 63, inclusive), herein incorporated by reference for its disclosure to oils of lubricating viscosity. The oil of lubricating viscosity is selected to provide lubricating compositions of at least SAE 60 grade. Preferably, the lubricating compositions have a grade of SAE 65, more preferably SAE 75. The lubricating composition may also have a so-called multigrade rating such as SAE 60W-80, preferably 65W-80 or 65W-90, more preferably 75W-80 or 75W-90, more preferably 75W-90.

One advantage of the compositions of the present invention is that there is no need for the use of overbased salts of organic acids, or boronated salts, or polysulfides, or ammonium salts, or phosphites, as have often been required in the past.

EXAMPLES

The following examples further illustrate aspects of the present invention but do not limit the intended scope of the present invention.

Power transmitting fluids were prepared containing the reaction product of a dihydrocarbyldithiophosphoric acid and a hydrocarbyl acrylate, specifically di-2-ethylhexyl dithiophosphoric acid and lauryl methacrylate. These reactants were combined at room temperature and then heated to 105° C. for 12–18 hours with stirring. The resulting reaction product was put in a base oil of 4 cSt viscosity to produce a power transmitting fluid such that the reaction product was present in the fluid at about 0.01 to about 3.0 weight percent.

Several fluids of the present invention were compared to the reference oil which did not contain the reaction product of a dihydrocarbyldithiophosphoric acid and a hydrocarbyl acrylate or acrylamide. The results are shown below. As the data illustrate, the reference fluid, consistently had significantly lower $\mu_d$ and $\mu_0$ values than were exhibited by the fluids of the present invention.

Reaction Product 1

Lauryl methacrylate was reacted with di-isodecyldithioic phosphoric acid in approximately equal molar amounts. The resulting reaction product is identified herein as Reaction Product 1.

Reaction Product 2

Lauryl methacrylate was reacted with di-isopropyl/methyl isobutylcarbinol mixed (IPA/MIBC) dithiophosphoric acid in approximately equal molar amounts. The resulting reaction product is referred to herein as Reaction Product 2.

| Sample A | Wt. % |
|---|---|
| Succinimide dispersant 950 MW PIB HiTEC ® 644 | 3.0 |
| Reaction Product 1 | 0.78 |
| Group III base oil, KV @ 100° C. = 4.0 cSt | 75.96 |
| Surfactant | 0.01 |
| Calcium phenate, low based detergent | 0.03 |
| Diphenylamine antioxidant | 0.31 |
| Octanoic acid anti-rust agent | 0.051 |
| Silicone anti-foam agent | 0.02 |
| Red Dye | 0.02 |
| 65 neutral base oil | 11.79 |
| Non-dispersant PMA viscosity index improver | 7.8 |
| Dithiazole copper corrosion inhibitor | 0.08 |
| Polymethacrylate, low MW, pour point depressant | 0.15 |

| Sample B | Wt. % |
|---|---|
| Succinimide dispersant 950 MW PIB HiTEC ® 644 | 3.0 |
| Reaction Product 2 | 0.51 |
| 65 neutral base oil | 11.79 |
| Group III base oil, KV @ 100° C. = 4.0 cSt | 75.02 |
| Surfactant | 0.01 |
| Calcium phenate, low based detergent | 0.03 |
| Diphenylamine antioxidant | 0.3 |
| Octanoic acid anti-rust agent | 0.05 |
| Silicone antifoam agent | 0.02 |
| Red dye | 0.02 |
| Non-dispersant PMA viscosity index improver | 8.55 |

In Tables 1 and 2, several oils made according to the above formulation of Sample 1, with the substitution of various alkyl groups on the reaction product of the dithioacid and the acrylate, were tested for frictional properties.

TABLE 1

Average Friction Levels from SAE #2 JASO Test

| Oil | $R_1$ | $R_2$ | $R_3$ | Z | $\mu_d$ | $\mu_0$ | $\mu_0/\mu_d$ | $\mu_s$ | $\mu_t$ |
|---|---|---|---|---|---|---|---|---|---|
| 1 | iso-$C_3$/MIBC mix | | $C_{12}$ | O | 0.155 | 0.155 | 1.00 | 0.181 | 0.180 |
| 2 | 2-EH | 2-EH | $C_{12}$ | O | 0.169 | 0.167 | 0.99 | 0.185 | 0.176 |
| 3 | iso-$C_{10}$ | iso-$C_{10}$ | $C_{12}$ | O | 0.160 | 0.158 | 0.99 | 0.178 | 0.171 |
| 4 | iso-$C_3$/MIBC mix | | $C_{16+18}$ | O | 0.153 | 0.160 | 1.04 | 0.173 | 0.170 |
| 5 | 2-EH | 2-EH | $C_{16+18}$ | O | 0.149 | 0.149 | 1.00 | 0.176 | 0.174 |
| 6 | iso-$C_{10}$ | iso-$C_{10}$ | $C_{16+18}$ | O | 0.158 | 0.157 | 0.99 | 0.175 | 0.171 |
| 7 | iso-$C_3$/MIBC mix | | DMAP | N | 0.156 | 0.160 | 1.02 | 0.198 | 0.195 |
| 8 | 2-EH | 2-EH | DMAP | N | 0.142 | 0.163 | 1.15 | 0.195 | 0.192 |
| 9 | No Friction Modifier | | | | 0.142 | 0.160 | 1.12 | 0.183 | 0.173 |
| 10 | N-containing Friction Modifiers | | | | 0.134 | 0.144 | 1.08 | 0.123 | 0.100 |
| 11 | Zinc dialkyldithiophosphate (ZZDP) | | | | 0.148 | 0.165 | 1.12 | 0.175 | 0.172 |
| Reference Oil | | | | | 0.139 | 0.141 | 1.015 | 0.140 | 0.126 |

"DMAP" is dimethylaminopropyl methacrylamide, also referred to herein as DMAPMAD. In the SAE #2 JASO test results of Table 1, the numbers are the average coefficient of friction measured over the range of 1000 to 5000 cycles. In this study, higher friction numbers are desired and a lower $\mu_0/\mu_d$ ratio, preferably below 1.0, is desired.

As the data in Table 1 illustrate, several formulations of the present invention containing the reaction product of a dihydrocarbyldithiophosphoric acid and a hydrocarbyl acrylate gave much better $\mu_0/\mu_d$ values than did the reference oil. The $\mu_0/\mu_d$ values for oils 1, 2, 3, and 5 were all below the $\mu_0/\mu_d$ value for the reference oil, which indicates and predicts an ability to provide improved anti-shudder performance. Oils 4, 6, and 7 had significantly higher friction numbers, $\mu_s$ and $\mu_t$, than the friction numbers for the reference oil.

In addition, the $\mu_d$ and $\mu_t$ friction values for oils 1–8 are all significantly higher (better) than the corresponding values for the reference fluid.

TABLE 2

Friction Stability in SAE #2 JASO Test Measured as a Change of Friction From 1000 to 5000 cycles

| Oil | $R_1$ | $R_2$ | $R_3$ | Z | $\mu_d$ | $\mu_0$ | $\mu_s$ | $\mu_t$ |
|---|---|---|---|---|---|---|---|---|
| 1 | iso-$C_3$/MIBC mix | | $C_{12}$ | O | 6.0 | 6.9 | −5.0 | −8.0 |
| 2 | 2-EH | 2-EH | $C_{12}$ | O | −8.0 | −5.8 | −3.0 | −2.0 |
| 3 | iso-$C_{10}$ | iso-$C_{10}$ | $C_{12}$ | O | −4.0 | −2.0 | −4.0 | −5.0 |
| 4 | iso-$C_3$/MIBC mix | | $C_{16+18}$ | O | 6.0 | 7.1 | 1.0 | −1.0 |
| 5 | 2-EH | 2-EH | $C_{16+18}$ | O | 4.0 | 6.0 | 4.0 | −6.0 |
| 6 | iso-$C_{10}$ | iso-$C_{10}$ | $C_{16+18}$ | O | −2.0 | 0.6 | −2.0 | −2.0 |
| 7 | iso-$C_3$/MIBC mix | | DMAP | N | 6.0 | 2.9 | 4.0 | 4.0 |
| 8 | 2-EH | 2-EH | DMAP | N | 13 | 4.6 | −7.0 | −6.0 |
| 9 | No Friction Modifier | | | | −6.0 | −6.6 | −5.0 | −3.0 |
| 10 | N-containing Friction Modifiers | | | | −4.0 | −11 | −5.0 | −1.0 |
| 11 | Zinc dialkyldithiophosphate (ZZDP) | | | | −24 | −12 | 1.0 | 1.0 |
| Reference Oil | | | | | −18 | −16 | 1.0 | 9.0 |

In Table 2, the numbers represent the friction stability as measured by the change in $\mu$ over time by subtracting the value at 5000 cycles from the values at 1000 cycles, or $\mu_{1000}-\mu_{5000}$, and multiplying the difference by 1000. Therefore, the negative signs can be ignored and it is the absolute values which are relevant. Lower absolute values are desired in this test as representing less change, and hence more friction stability over time.

As the data in Table 2 illustrate, the oils 1 through 8 of the present invention all gave absolute values for the change in friction well below the value for the change in friction exhibited reference oil.

In addition, it can be seen that the use of power transmitting compositions of the present invention can provide a method of improving simultaneously the stability, durability, and torque capacity of an automatic transmission fluid or CVT fluid by lubricating a transmission with a composition of the present invention.

Thus, the examples and data herein demonstrate the superiority in friction durability of the power transmitting fluids of the present invention. Further, the ATF and CVT compositions of the present invention contain the reaction product obtained by combining a dithiophosphoric acid and a hydrocarbyl acrylate in a base oil of lubricating viscosity, and further containing a dispersant and, optionally, a VII.

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims. This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentee does not intend to dedicate any disclosed embodiments to the public, and to the extent any disclosed modifications or alterations may not literally fall within the scope of the claims, they are considered to be part of the invention under the doctrine of equivalents.

What is claimed is:

1. A power transmitting fluid composition comprising:

a) a major amount of an oil of lubricating viscosity;

b) a minor amount of the reaction product of a hydrocarbyl acrylate with a dihydrocarbyldithiophosphoric acid;

c) an ashless dispersant; and optionally d) a viscosity index improver.

2. The composition of claim 1, wherein the molar ratio of the hydrocarbyl acrylate to the dihydrocarbyldithiophosphoric acid is from about 1:99 to 99:1.

3. The composition of claim 1, wherein the molar ratio of the hydrocarbyl acrylate to the dihydrocarbyldithiophosphoric acid is from about 1:3 to 3:1.

4. The composition of claim 1, wherein the molar ratio of the hydrocarbyl acrylate to the dihydrocarbyldithiophosphoric acid is about 1:1.

5. The composition of claim 1, wherein the hydrocarbyl group of the hydrocarbyl acrylate is $C_6$ to $C_{20}$.

6. The composition of claim 1, wherein the hydrocarbyl group of the hydrocarbyl acrylate is $C_{12}$ to $C_{18}$.

7. The composition of claim 1, wherein the hydrocarbyl group of the hydrocarbyl acrylate is $C_{12}$.

8. The composition of claim 1, wherein the hydrocarbyl acrylate is selected from lauryl methacrylate, cetyl eicosyl methacrylate, and dimethylaminopropyl methacrylamide.

9. The composition of claim 1, wherein the hydrocarbyl acrylate is lauryl methacrylate.

10. The composition of claim 1, wherein the hydrocarbyl acrylate is cetyl eicosyl methacrylate.

11. The composition of claim 1, wherein the hydrocarbyl acrylate is dimethylaminopropyl methacrylamide.

12. The composition of claim 1, wherein the hydrocarbyl acrylate is selected from isobutyl acrylate; tert-butyl acrylate; n-hexyl acrylate; n-hexyl methacrylate; isodecyl methacrylate; lauryl methacrylate; stearyl methacrylate; isooctyl acrylate; lauryl acrylate; stearyl acrylate; cyclohexyl acrylate; cyclohexyl methacrylate; methoxy ethyl acrylate; isobenzyl acrylate; isodecyl acrylate; n-dodecyl acrylate; benzyl acrylate; isobornyl acrylate; isobornyl methacrylate; 2-hydroxyethyl acrylate; 2-hydroxypropyl acrylate; 2-methoxyethyl acrylate; 2-methoxybutyl acrylate; 2-(2-ethoxyethoxy) ethyl acrylate; 2-phenoxyethyl acrylate; tetrahydrofurfuryl acrylate; 2-(2-phenoxyethoxy) ethyl acrylate; methoxylated tripropylene glycol monoacrylate; 1,6-hexanediol diacrylate; ethylene glycol dimethacrylate; diethylene glycol dimethacrylate; triethylene glycol dimethacrylate; polyethylene glycol dimethacrylate; butylene glycol dimethacrylate; trimethylolpropane 3-ethoxylate triacrylate; 1,4-butanediol diacrylate; 1,9-nonanediol diacrylate; neopentyl glycol diacrylate; tripropylene glycol diacrylate; tetraethylene glycol diacrylate; heptapropylene glycol diacrylate; trimethylol propane triacrylate; ethoxylated trimethylol propane triacrylate; pentaerythritol triacrylate; trimethylolpropane trimethacrylate; tripropylene glycol diacrylate; pentaerythritol tetraacrylate; glyceryl propoxy triacrylate; tris(acryloyloxyethyl) phosphate; 1-acryloxy-3-methacryloxy glycerol; 2-methacryloxy-N-ethyl morpholine; and allyl methacrylate; and mixtures thereof.

13. The composition of claim 1, wherein the dihydrocarbyldithiophosphoric acid is a dialkyldithiophosphoric acid.

14. The composition of claim 13, wherein the alkyl groups of the dialkyldithiophosphoric acid are independently selected from methyl, ethyl, n-propyl, i-propyl, n-butyl, i-butyl, t-butyl, pentyl, hexyl, heptyl, octyl, 2-ethyl hexyl, nonyl, decyl, undecyl, dodecyl, lauryl, eicosyl, cetyl, and mixtures thereof.

15. The composition of claim 13, wherein the alkyl groups of the dialkyldithiophosphoric acid are methyl.

16. The composition of claim 13, wherein the alkyl groups of the dialkyldithiophosphoric acid are ethyl.

17. The composition of claim 1, wherein the dihydrocarbyldithiophosphoric acid is selected from iso-propyl/methylisobutylcarbinol mixed dithiophosphoric acid, 2-ethylhexyl dithiophosphoric acid, and isodecyl dithiophosphoric acid.

18. The composition of claim 1, wherein the dihydrocarbyldithiophosphoric acid comprises di-iso-propyl/methylisobutylcarbinol mixed dithiophosphoric acid.

19. The composition of claim 1, wherein the dihydrocarbyldithiophosphoric acid comprises di-2-ethyl hexyl dithiophosphoric acid.

20. The composition of claim 1, wherein the dihydrocarbyldithiophosphoric acid comprises di-isodecyl dithiophosphoric acid.

21. The composition of claim 1, wherein the ashless dispersant is selected from boron-containing and phosphorus-containing succinimide dispersant, succinic ester dispersant, succinic ester-amide dispersant, Mannich base dispersant, hydrocarbyl polyamine dispersant, and polymeric polyamine dispersant.

22. The composition of claim 1, wherein the ashless dispersant is a succinimide dispersant.

23. The composition of claim 22, wherein the succinimide dispersant has an alkyl substitutent.

24. The composition of claim 23, wherein the alkyl substituent on the succinimide dispersant is a polyisobutylene group.

25. The composition of claim 1, wherein the ashless dispersant is present in an amount of from about 1.0 percent to about 10.0 percent by weight.

26. The composition of claim 1, wherein the viscosity index improver is selected from olefin copolymer VIIs, polyalkylmethacrylate VIIs, and styrene-maleic ester VIIs.

27. The composition of claim 1, wherein the viscosity index improver is a polymethacrylate viscosity index improver.

28. The composition of claim 1, wherein the viscosity index improver is present in an amount of from about 1 to about 25 percent by weight.

29. The composition of claim 1, wherein the reaction product of the hydrocarbyl acrylate and the dihydrocarbyldithiophosphoric acid is present in an amount of from about 0.3 to about 5.0 weight percent.

30. A method of increasing the durable torque capacity of a power transmitting fluid, comprising adding to a power transmitting fluid a composition of claim 1.

31. A method for improving the power transmission of a vehicle with an automatic transmission, comprising lubricating the automatic transmission of the vehicle with a lubricating oil comprising the composition of claim 1.

32. A method for reducing the shudder in a vehicular automatic transmission, comprising lubricating the automatic transmission of the vehicle with a lubricating oil comprising the composition of claim 1.

33. A lubricating oil comprising a composition of claim 1, wherein the oil of lubricating viscosity is selected from animal oils, vegetable oils, mineral lubricating oils, solvent or acid treated mineral oils, oils derived from coal or shale, hydrocarbon oils, halo-substituted hydrocarbon oils, alkylene oxide polymers, esters of dicarboxylic acids, esters of polyols, esters of phosphorus-containing acids, polymeric tetrahydrofurans, silicon-based oils, and mixtures thereof.

34. The lubricating oil of claim 33, further comprising at least one additive selected from corrosion inhibitors, rust inhibitors, oxidation inhibitors, viscosity improvers, pour point depressants, friction modifiers.

35. A lubricant additive concentrate comprising a composition of claim 1.

36. A transmission lubricated with an oil comprising the composition of claim 1.

37. A transmission lubricated with the lubricating oil of claim 33.

38. A method of improving simultaneously the stability, durability, and torque capacity of an automatic transmission fluid comprising lubricating an automatic transmission with a composition of claim 1.

39. The power transmitting fluid of claim 1, wherein the fluid is an automatic transmission fluid.

40. A method of improving simultaneously the stability, durability, and torque capacity of a continuously variable transmission fluid comprising lubricating a continuously variable transmission with a composition of claim 1.

41. The power transmitting fluid of claim 1, wherein the fluid is a continuously variable transmission fluid.

* * * * *